US005589760A

United States Patent [19]

Lee

[11] Patent Number: 5,589,760

[45] Date of Patent: Dec. 31, 1996

[54] TRAVELLER'S VOLTAGE CONVERTER FOR AUTOMATICALLY SELECTING LOAD WATTAGE

[76] Inventor: Anthony Lee, C/O Hung Hsing Service Center P.O. Box 55-1670, Taipei, Taiwan

[21] Appl. No.: 523,354

[22] Filed: Sep. 5, 1995

[51] Int. Cl.[6] ..... G05F 1/12

[52] U.S. Cl. ..... 323/247

[58] Field of Search ..... 323/234, 247, 323/249, 254, 355, 358; 363/49, 59, 170, 171

[56] References Cited

U.S. PATENT DOCUMENTS 4,213,083 7/1980 Freygang ..... 323/247
4,631,652 12/1986 Wendt ..... 363/16
4,896,093 1/1990 Spires ..... 323/247
5,159,545 10/1992 Lee ..... 363/146

*Primary Examiner*—Matthew V. Nguyen

[57] ABSTRACT

A voltage converter for traveller's uses includes: a 50 watts (0–50 W) transformer for converting an input voltage of 220 VAC to an output voltage of 110 VAC for normally powering a load of 50 watts or less; a 1600 watts (50–1600 W) transformer for converting an intput voltage of 220 VAC to an output voltage of 110 VAC for powering a load ranging from 50 watts to 1600 watts; and a sensing control circuit operatively sensing an output load having a power rating larger than 50 watts (50 W to 1600 W) for operatively actuating a relay for automatically switching an output terminal of the 50 watts transformer to the output terminal of the 1600 watts transformer for preventing burning or damaging of the output load connected with the voltage converter and for protecting the voltage converter itself.

3 Claims, 3 Drawing Sheets

TRAVELLER'S VOLTAGE CONVERTER FOR AUTOMATICALLY SELECTING LOAD WATTAGE

BACKGROUND OF THE INVENTION

A conventional 50 watts transformer for converting an input voltage of 220 volts AC to an output voltage of 110 volts AC may serve as a traveller's voltage converter for portable uses. Since the 50 watts (W) transformer may only be provided for those electronic or electric appliances such as portable personal computer having a load wattage less than 50 watts, an uncareful using of such a 50 W low-load transformer for those electric appliances of higher load up to 1600 W, such as: hair dryer, coffee maker or travel iron, may burn out the transformer or the fuse to lose the power transforming function, possibly causing inconvenience especially when travelling in European and Middle East areas.

A conventional 1600 watts traveller's transformer for converting 220 volts (AC) to 110 volts (AC) may be provided for powering the electric appliances with power rating from 50 watts to 1600 watts such as for uses in those appliances requiring higher wattage such as hair dryer, travel iron and coffee maker. It includes a bidirectional diode thyristor (DIAC) and a bidirectional triode thyristor (TRIAC) for stepping down the voltage from 220 volts to 110 volts. However, the peak voltage output from such a 1600 W transformer is 220 VAC, rather than the reduced voltage value of 110 VAC, still possibly damaging the electronic appliance containing integrated circuit (IC), transistors and other electronic parts vulnerable to high voltage of 220 volts.

Naturally, a combination of 50 W transformer with a 1600 W transformer may be derived from the aforementioned two transformers, which may be selected for either 50 watts load or 1600 watts depending upon the end-use requirement by manipulating a selector rotatably mounted in a casing of the transformers. However, a false or careless manual selection may burn out the electronic appliance if accidentally selecting the power rating of 1600 W; or may destroy the 50 W transformer if selecting the power rating of 50 W while adopting a load larger than 50 W.

SUMMARY OF THE INVENTION

According to the present invention there is provided a voltage converter for stepping down an input voltage of 220 volts (AC) to an output voltage of 110 volts (AC), which may automatically distinguish the load wattage whether a 50 watts (0–50 W) load or a 1600 watts (50–1600 W) load and then automatically connect the proper output load with a 50 watts transformer or a 1600 watts transformer commonly stored in a housing, without damaging the output load and the converter itself.

The object of the present invention is to provide a voltage converter for traveller's uses, including: a 50 watts transformer for converting an input voltage of 220 VAC to an output voltage of 110 VAC for normally powering a load of 50 watts or less; a 1600 watts transformer for converting an intput voltage of 220 VAC to an output voltage of 110 VAC for powering a load ranging from 50 watts to 1600 watts; and a sensing control circuit operatively sensing an output load having a power rating larger than 50 watts (50 W to 1600 W) for operatively actuating a relay for automatically switching an output terminal of the 50 watts transformer to the output terminal of the 1600 watts transformer for preventing burning or damaging of the output load connected with the voltage converter and for preventing burning or damaging of the converter itself.

DETAILED DESCRIPTION

Figure 1:
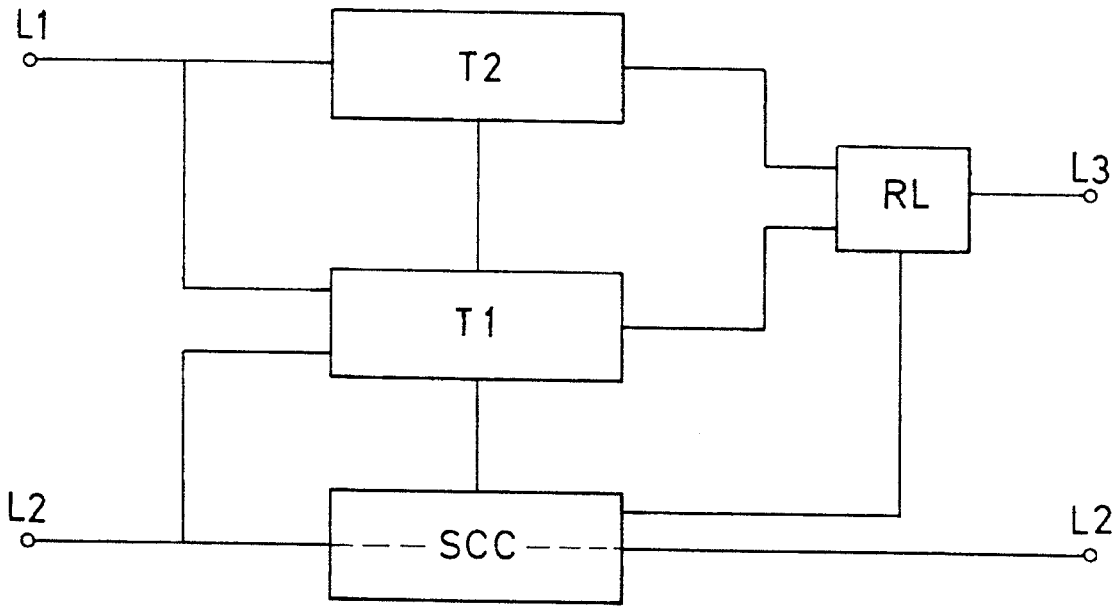
FIG. 1 is a block diagram of the present invention.
Figure 2:
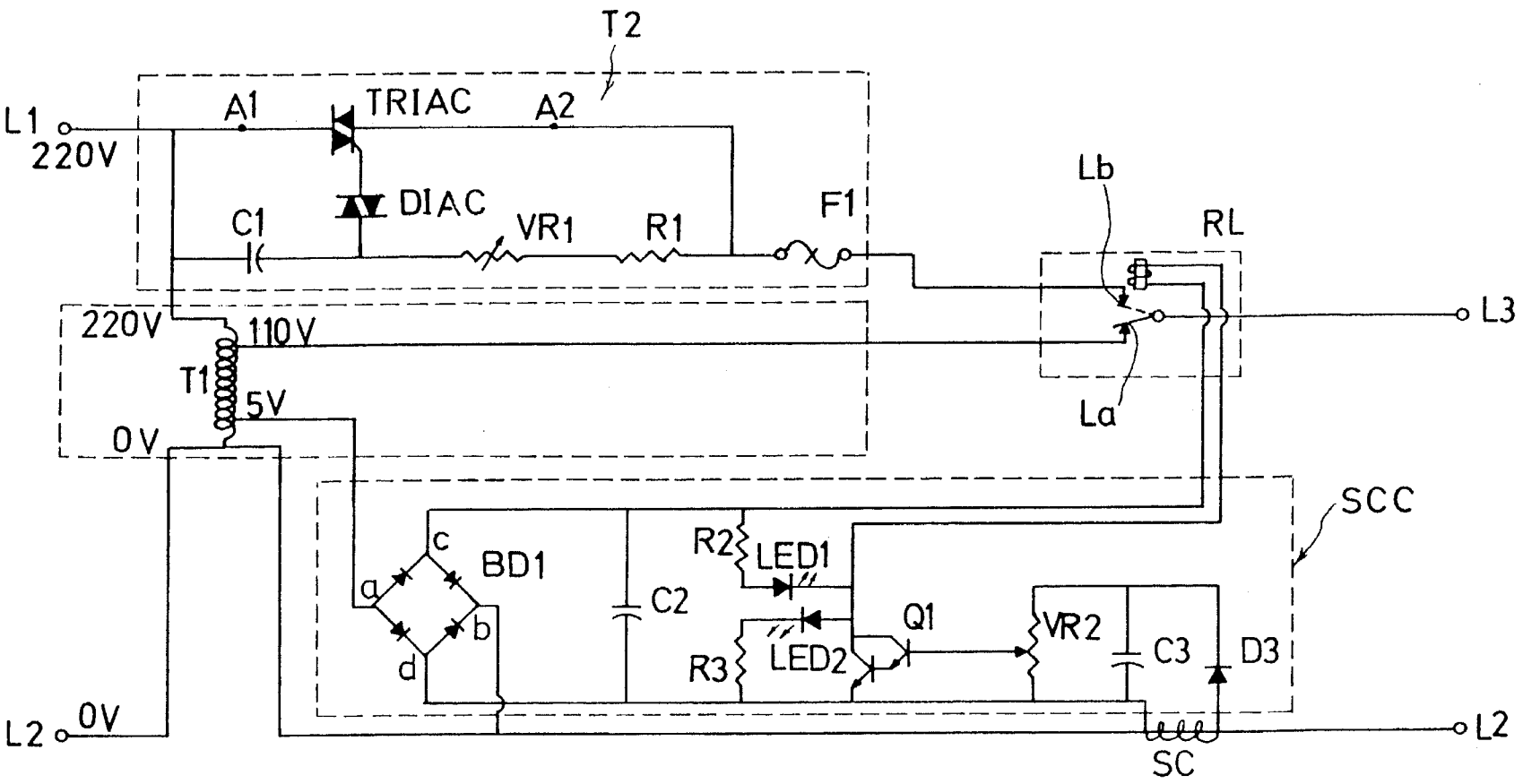
FIG. 2 is an electronic circuit diagram in accordance with the present invention.
Figure 3:
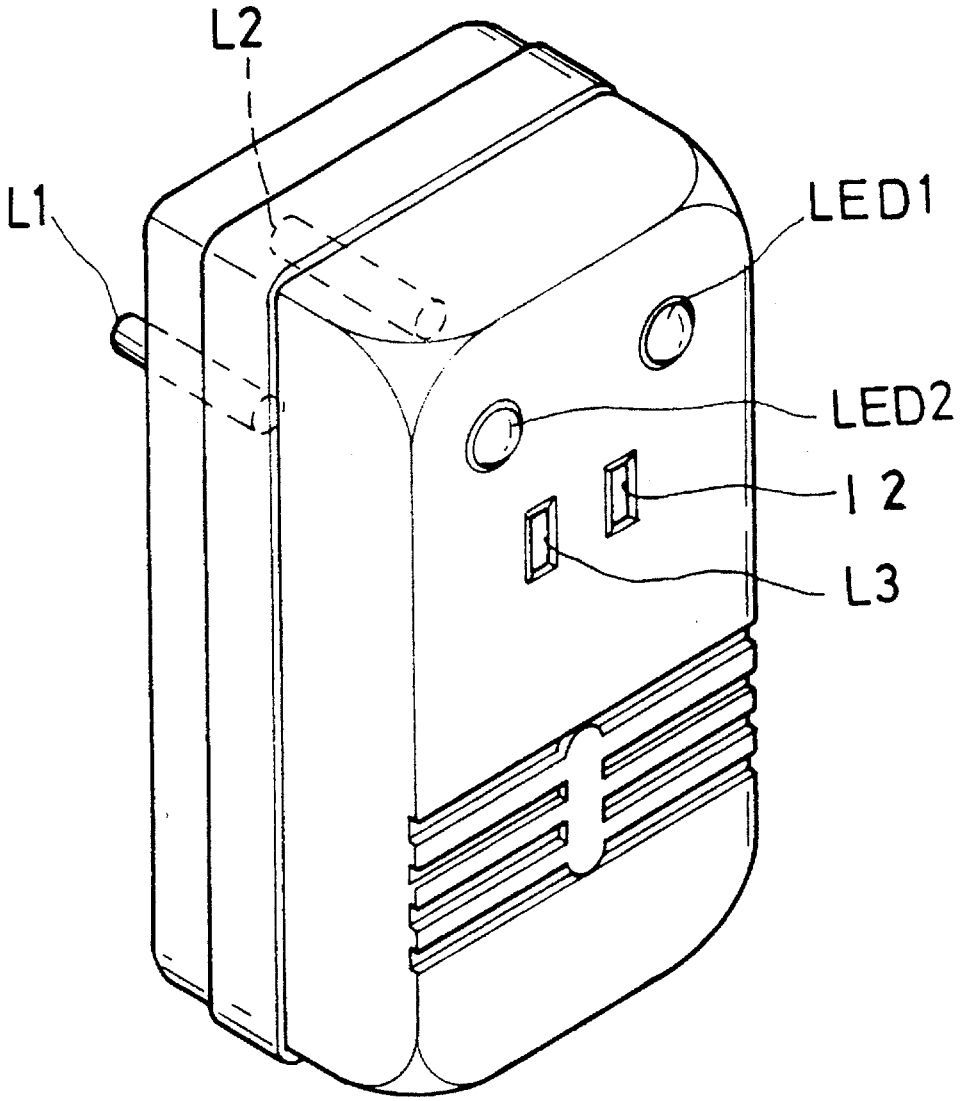
FIG. 3 is an illustration showing a perspective view of the present invention when assembled in a casing.

As shown in the drawing figures, the present invention comprises: a low-wattage transformer T1 for converting an input voltage of 220 volts AC (alternating current) to an output voltage of 110 volts AC for a first load of low wattage such as of 50 watts or less; a high-wattage transformer T2 for converting an input voltage of 220 volts AC to an output voltage of 110 volts AC for a second load of high wattage such as from 50 watts to 1600 watts; and a sensing control circuit SCC operatively sensing an output load and switching an output terminal of the converter from an output terminal of the low-wattage transformer T1 to an output terminal of the high-wattage transformer T2 for connecting the load safely.

The low-wattage transformer T1 is an autotransformer having an input voltage of 220 volts AC across a hot input terminal L1 and a neutral terminal L2 and having an output voltage of 110 volts AC across a hot output terminal L3 through a contactor La of the transformer T1 and the neutral terminal L2 whereby upon connection of a load such as an electronic appliance with the hot output terminal L3 and neutral terminal L2 to pass current through the load, an output power rating up to 50 watts will be obtained.

The high-wattage transformer T2 includes: a bidirectional triode thyristor (TRIAC) having two triode terminals A1, A2 disposed in between a hot input terminal L1 and a hot output terminal L3 when operatively connected by a relay RL as controlled by a sensing control circuit SCC; a fuse F1 connected between the TRIAC and the output terminal L3 for protecting the circuit of the high-wattage transformer T2; the hot input terminal L1 inputting an input voltage of 220 volts AC with the neutral terminal L2 having the low-wattage transformer T1 connected across the hot input terminal L1 and the neutral terminal L2; a capacitor C1 connected with a variable resistor VR1 and a resistor R1 in series, and connected in parallel with the TRIAC; a bidirectional diode thyristor DIAC having a first lead connected to a gate of the TRIAC and having a second lead connected in between the capacitor C1 and the variable resistor VR1, whereby upon connection of a contactor Lb of the high-wattage transformer T2 with the hot output terminal L3 as actuated by the relay RL, the input voltage of 220 volts AC will be converted by the high-wattage transformer T2 to have an output voltage of 110 volts AC with a power rating up to 1600 watts by designing the TRIAC to allow a maximum current of 16 amperes to pass through the TRIAC.

The operating principle of the high-wattage transformer T2 will be described hereinafter.

The high-wattage transformer T2 and the low-wattage transformer T1 may be selected from any conventional transformer for converting 220 VAC to 110 VAC.

Upon connection of the contactor Lb of the transformer T2 with the hot output terminal L3 and applying the load across the two terminals L3, L2 to close the circuit of the high-wattage transformer T2 as actuated by the relay RL, the current passes through the capacitor C1, the variable resistor VR1 and the resistor R1 to charge the capacitor C1 in a predetermined time period which can be adjusted by varying the resistance of VR1 and R1, depending upon the practical requirement for outputing transformed voltage and current until reaching a breakover voltage of the DIAC, thereby conducting the DIAC which will in turn trigger the gate of the TRIAC to conduct the TRIAC between the two triode terminals A1, A2 of the TRIAC in order to convert the input voltage of 220 volts AC to 110 volts AC. Since the maximum current passing through the TRIAC is designed to be 16 amperes, the load applied across the two terminals L3, L2 will be 1600 watts or less.

The high-wattage transformer T2 may have an output power rating of 1600 watts or less.

Other types of transformers may also be chosen for uses in this invention, not limited in this invention.

The sensing control circuit SCC includes: a bridge rectifier BD1 consisting of four diodes arranged in a bridge configuration and having a first bridge terminal a positioned between two anodes of two neighboring diodes and connected to a low-voltage output lead 5 V output from the low-wattage transformer T1 for leading a power source of 5 volts to supply power to the sensing control circuit SCC, a second bridge terminal b positioned between two cathodes of two neighboring diodes and connected to a neutral terminal L2, a third and a fourth bridge terminal c, d each terminal connected to a cathode of a diode connected to the first terminal a and connected to an anode of a diode connected to the second terminal b and both terminals c, d respectively connected to two coil ends of a relay RL operatively switching on a contactor Lb of the high-wattage transformer T2 by switching off the contactor La of the low-wattage transformer T1; a low-wattage light-emitting diode LED2 connected with a resistor R3 and connected between the two terminals c, d for lighting the LED2 when the low-wattage transformer T1 is activated by normally connecting the contactor La of the low-wattage transformer T1 to the hot output terminal L3 having a low-wattage load connected across the two terminals L3, L2; a transistor Q1 connected between the fourth bridge terminal d and the relay RL; a sensing coil SC wound on a lead of the neutral terminal L2 with a first-end lead of the sensing coil SC connected to the fourth bridge terminal d and a second-end lead of the sensing coil SC connected to a base of the transistor Q1 through a diode D3, a capacitor C3 and a variable resistor VR2 with the diode D3 and the variable resistor VR2 connected in parallel between the first-end lead and the second-end lead of the sensing coil SC; the transistor Q1 having the base connected to the variable resistor VR2, the collector connected to the relay RL and the emitter connected to the fourth bridge terminal d and the sensing coil SC; a high-wattage light-emitting diode LED1 connected between two coil ends of the relay RL through a resistor R2 for lighting the LED1 upon actuation of the relay RL to switch on the contactor Lb of the high-wattage transformer T2 upon connection of high-wattage load across the two terminals L3, L2, and a capacitor C2 connected across the third bridge terminal C and the fourth bridge terminal d for filtering interference signals and for stabilizing the voltage in the sensing control circuit SCC.

The transistor Q1 may be a Darlington pair transistors by connecting together the collectors of the two transistors, while feeding the emitter of one transistor to the base of the other transistor so as to have a large current gain for sensitively detecting an induced current in the sensing coil SC when a large current passes through a high-wattage load across the two terminal L3, L2.

When using the present invention for supplying power to a load of an electric or electronic appliance (not shown) of 50 watts or less, since the contactor La of the low-wattage transformer T1 is normally connected to the hot output terminal L3, the lead will be conducted with current at a reduced voltage of 110 VAC as converted from the transformer windings of the low-wattage wattage transformer T1. The LED2 will be turned on to indicate the activation of low-wattage transformer T1 since the power source of 5 V will be led to the LED2 through the bridge rectifier BD1.

If the load has a high wattage more than 50 watts and less than 1600 watts (electric appliances for travelling use generally being less than 1600 W), the current due to the high wattage of the load will induce a current signal in the sensing coil SC of the sensing control circuit SCC, in which the current signal, after being rectified by the diode D3 and filtered by the capacitor C3 for stabilizing the voltage of the sensed signal, will be led to the base of the transistor Q1 to increase a biasing voltage between the emitter and the base of the transistor Q1 in order to shortcircuit the collector and the emitter of the transistor Q1, thereby conducting the current across the bridge terminals c, d and the coil windings of the relay RL to energize the relay RL to electromagnetically switch on the contactor Lb of the high-wattage transformer T2 by switching off the contactor La of the low-wattage transformer T1 for connecting the hot output terminal L3 and the high-wattage load across the hot output terminal L3, and neutral terminal L2 so as to power the load at high wattage up to 1600 watts without damaging the low-wattage transformer T1.

The present invention may be provided to automatically distinguish a high wattage load (1600 W) or a lower wattage load (50 W) and then automatically connect the proper transformer to supply the power with reduced voltage of 110 VAC, thereby increasing the power connection convenience and enhancing electrical safety for a traveller.

The present invention may be modified without departing from the spirit and scope of this invention.

I claim:

1. A voltage converter for traveller's uses for automatically selecting load wattage comprising:

a low-wattage transformer for converting an input voltage of 220 volts AC across a hot input terminal and a neutral terminal to an output voltage of 110 volts AC across a hot output terminal and the neutral terminal for powering a low-wattage load connected across said hot output terminal and said neutral terminal;

a high-wattage transformer for converting an input voltage of 220 volts AC across said hot input terminal and said neutral terminal to an output voltage of 110 volts AC across said hot output terminal and said neutral terminal to obtain an output power rating of wattage value greater than that of said low-wattage transformer for powering a high-wattage load connected across said hot output terminal and said neutral terminal;

a sensing control circuit connected between said low-wattage transformer and said neutral terminal, and operatively sensing an induced current signal from a lead of said neutral terminal when led to a high-wattage load; and a relay connected to said sensing control circuit and normally connecting a first contactor of said low-wattage transformer with said hot output terminal, and operatively actuated by said induced current signal from said sensing control circuit for switching on a second contactor of said high-wattage transformer to connect the hot output terminal with the high-wattage transformer for powering the high-wattage load when connected between said hot output terminal and said neutral terminal.

2. A voltage converter according to claim 1, wherein said sensing control circuit (SCC) includes: a bridge rectifier (BD1) consisting of four diodes arranged in a bridge configuration having a first bridge terminal (a) connected to a low-voltage output lead output from the low-wattage transformer (T1) for leading a power source to supply power to the sensing control circuit (SCC), a second bridge terminal (b) connected to said neutral terminal (L2), a third and a fourth bridge terminal (c, d) respectively connected to two coil ends of said relay (RL) operatively switching on said second contactor (Lb) of the high-wattage transformer (T2) when switching off said first contactor (La) of the low-wattage transformer (T1); a transistor means (Q1) connected between the fourth bridge terminal (d) and said relay (RL); and a sensing coil (SC) wound on a lead of the neutral terminal (L2) with a first-end lead of the sensing coil (SC) connected to the fourth bridge terminal (d) and a second-end lead of the sensing coil (SC) connected to a base of the transistor means (Q1) through a diode (D3), a capacitor (C3) and a variable resistor (VR2) with the diode (D3) and the variable resistor (VR2) connected in parallel between the first-end lead and the second-end lead of the sensing coil (SC); the transistor means (Q1) having the base connected to the variable resistor (VR2), the collector connected to the relay (RL) and the emitter connected to the fourth bridge terminal (d) and the sensing coil (SC).

3. A voltage converter according to claim 1, wherein said transistor means (Q1) is a Darlington pair transistors having two collectors of two transistors connected together and connected to the relay (RL), and having the emitter of a first transistor connected to a base of a second transistor having the emitter of the second transistor connected to the bridge rectifier (BD1) and the sensing coil (SC).

* * * * *